US010553351B2

(12) United States Patent
Jitaru et al.

(10) Patent No.: US 10,553,351 B2
(45) Date of Patent: Feb. 4, 2020

(54) MULTIPLE CELLS MAGNETIC STRUCTURE FOR WIRELESS POWER

(71) Applicant: DET International Holding Limited, Grand Cayman (KY)

(72) Inventors: Ionel Jitaru, Tucson, AZ (US); Andrei Ion Radulescu, Targoviste (RO); Marco Antonio Davila, Tucson, AZ (US); Andrei Savu, Bucharest (RO)

(73) Assignee: DELTA ELECTRONICS (THAILAND) PUBLIC CO., LTD., Samutprakarn (TH)

( * ) Notice: Subject to any disclaimer, the term of this patent is extended or adjusted under 35 U.S.C. 154(b) by 791 days.

(21) Appl. No.: 13/887,350

(22) Filed: May 5, 2013

(65) Prior Publication Data

US 2013/0314200 A1 Nov. 28, 2013

Related U.S. Application Data

(60) Provisional application No. 61/642,785, filed on May 4, 2012.

(51) Int. Cl.
*H01F 27/24* (2006.01)
*H01F 38/14* (2006.01)

(52) U.S. Cl.
CPC ..... *H01F 38/14* (2013.01)

(58) Field of Classification Search
CPC ..... H01F 38/10; H01F 3/14; H01F 27/2847; H01F 27/245
USPC ..... 336/160, 165, 178, 212, 221
See application file for complete search history.

(56) References Cited

U.S. PATENT DOCUMENTS 1,614,161 A * 1/1927 Stahl ..... H01F 30/12 336/160
1,876,451 A 9/1932 Telefunken
2,064,773 A * 12/1936 Vogt ..... H01F 1/26 264/104
3,502,966 A * 3/1970 Bulgakov ..... G01P 3/52 323/348

(Continued)

FOREIGN PATENT DOCUMENTS

CN 105186711 A * 12/2015
DE 10112892 A2 10/2002

(Continued)

OTHER PUBLICATIONS

Masato Chigira et al: "Small-size light-weight transformer with new core structure for contactless electric vehicle power transfer system", Energy Conversion Congress and Exposition (ECCE), 2011 IEEE, IEEE, Sep. 17, 2011, pp. 260-266.

(Continued)

*Primary Examiner* — Tszfung J Chan
(74) *Attorney, Agent, or Firm* — Vector IP Law Group LLC; Robert S. Babayi

(57) ABSTRACT

An improved primary or secondary side pad for a wireless transformer for inductive power transfer through an air gap is provided. The primary or secondary side pad includes a first plate, a second plate, and at least two rods which are linking the first and the second plate, where a winding is wound around each rod. A wireless transformer for inductive power transfer through an air gap includes a primary side pad and a secondary side pad of the transformer which is identical in shape and size.

18 Claims, 15 Drawing Sheets

(56) References Cited

U.S. PATENT DOCUMENTS 3,668,589 A * 6/1972 Wilkinson ..... H01F 27/255 336/212
4,030,058 A * 6/1977 Riffe ..... H01F 38/14 204/196.18
4,301,404 A 11/1981 Ley
4,447,795 A * 5/1984 Sefko ..... H01F 27/245 336/172
4,471,271 A * 9/1984 Wendt ..... G05F 3/06 315/411
4,705,975 A * 11/1987 Ritzinger ..... H02K 24/00 310/111
4,782,582 A * 11/1988 Venezia ..... H01F 41/02 29/605
5,767,667 A * 6/1998 Shafie ..... G01R 19/20 324/117 R
2004/0085174 A1* 5/2004 Decristofaro ..... H01F 3/14 336/178
2004/0119576 A1 6/2004 Nakao
2004/0130426 A1* 7/2004 Suzuki ..... H01F 27/24 336/212
2004/0232845 A1 11/2004 Baarman
2005/0116683 A1* 6/2005 Cheng ..... H01F 3/02 320/108
2005/0140482 A1 6/2005 Cheng
2008/0048814 A1* 2/2008 Weger ..... H01F 27/38 336/182
2009/0237197 A1* 9/2009 Ikriannikov ..... H01F 3/14 336/212
2010/0171580 A1* 7/2010 Abe ..... H01F 37/00 336/178
2010/0176908 A1* 7/2010 Mori ..... H01F 17/0013 336/226
2010/0308939 A1 12/2010 Kurs
2011/0025445 A1* 2/2011 Lai ..... H01F 3/10 336/220
2012/0056706 A1* 3/2012 Schafer ..... H01F 27/266 336/212

FOREIGN PATENT DOCUMENTS

| | | | | |
|---|---|---|---|---|
| EP | 0507360 | A2 | 10/1992 | |
| EP | 1011187 | A1 | 6/2000 | |
| EP | 1634366 | A1 | 3/2006 | |
| EP | 2172952 | A1 | 4/2010 | |
| EP | 2196351 | A1 | 6/2010 | |
| FR | 2663452 | A3 * | 12/1991 | ..... H01F 27/255 |
| GB | 2458476 | A | 9/2009 | |
| JP | 09266121 | A1 * | 10/1997 | |
| JP | 2001076598 | A | 3/2001 | |
| JP | 2004119748 | A * | 4/2004 | |
| JP | 2004119748 | A * | 4/2004 | |
| JP | 2009123727 | A | 6/2009 | |
| JP | 2011142177 | A | 7/2011 | |
| WO | 9948130 | A1 | 9/1999 | |
| WO | 0116995 | A1 | 3/2001 | |
| WO | 2008140333 | A2 | 11/2008 | |
| WO | 2009111597 | A2 | 9/2009 | |
| WO | 2010/090538 | A1 | 8/2010 | |
| WO | 2010090538 | A1 | 8/2010 | |
| WO | 2010090539 | A1 | 8/2010 | |
| WO | 2011148289 | A2 | 12/2011 | |
| WO | 2012008693 | A2 | 1/2012 | |
| WO | 2012/018268 | A1 | 2/2012 | |
| WO | 2012018268 | A1 | 2/2012 | |

OTHER PUBLICATIONS

European Patent Office Search Report, dated Jan. 13, 2014, Application No. EP 13405057.4.

* cited by examiner

MULTIPLE CELLS MAGNETIC STRUCTURE FOR WIRELESS POWER

RELATED APPLICATION/CLAIM OF PRIORITY

This application is related to and claims priority from U.S. Provisional application Ser. No. 61/642,785, entitled Multiple Cells Magnetic Structure for Wireless Power, filed May 4, 2012, which provisional application is incorporated herein by reference.

1. INTRODUCTION

Wireless energy transfer gains more and more attention from the power electronics industry today. This technique of sending the energy through a large air gap or any other nonconductive material can solve the mobility problem of portable devices and extend their battery autonomy.

The main challenge is to transfer the power over great distance as efficient as possible. This is achieved using a wireless transformer composed by a primary and a secondary side inductively coupled. The energy is transferred from the primary to the secondary through an air gap. Bigger the gap, the greater the reluctance of the air and the harder for the magnetic flux lines to penetrate through the air, is desired to keep the reluctance value as low as possible for better coupling thus higher efficiency.

The purpose of this invention is to transfer power efficiently at a large distance, over an air gap.

This application is accompanied by FIGS. 1-16 which are reproduced and described in the description that follows.

2. PRIOR ART

A method of transferring power at a large distance is defined as Inductive Power Transfer (IPT) which is achieved through inductive coupling in a similar manner to conventional tight coupled transformers. IPT systems have coupling coefficients between 0.01 and 0.5 due to large air gaps compared to over 0.95 in transformers.

One of the most important part of an IPT system is the wireless transformer. Magnetic structures for the wireless transformer have been studied by John T. Boys and Grant A. Covic in [1]. One structure type is the flat power pad [FIG. 1]. The flat power pad is composed by ferrite core and two parallel connected coils that are winded around the center post. The coils are situated in the extremities of the center post. Ferrite extensions called wings are assigned on the outer edges.

Figure 1:
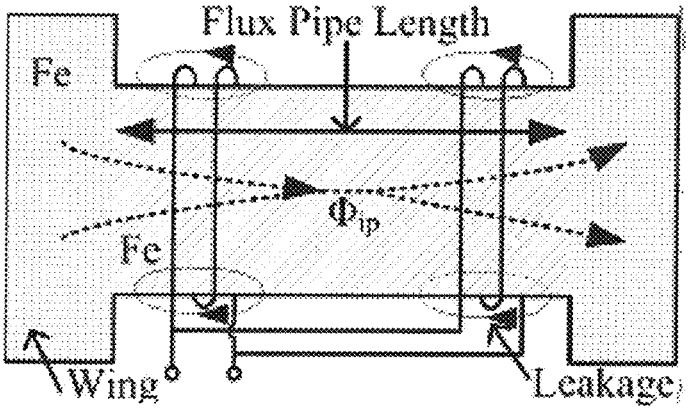
FIG. 1 is a top view of a magnetic structure that can be either the primary or the secondary side of a wireless transformer because the two parts have identical shape and size.

FIG. 1 is a top view of the magnetic structure that can be either the primary or the secondary side of the wireless transformer because the two parts have identical shape and size.

Figure 2:
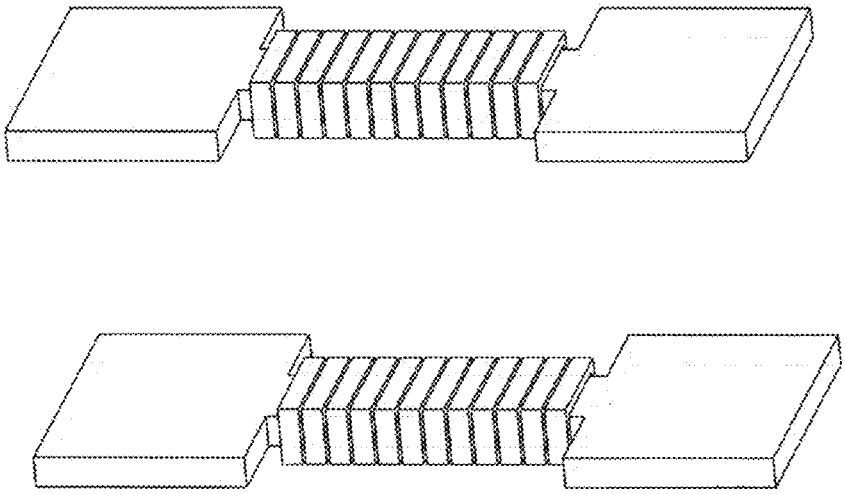
FIG. 2 is a lateral view of the wireless transformer composed by two power pads.

A lateral view of the wireless transformer composed by two power pads is shown in FIG. 2

The Present Invention

3. MULTI-CELL STRUCTURE

Figure 3:
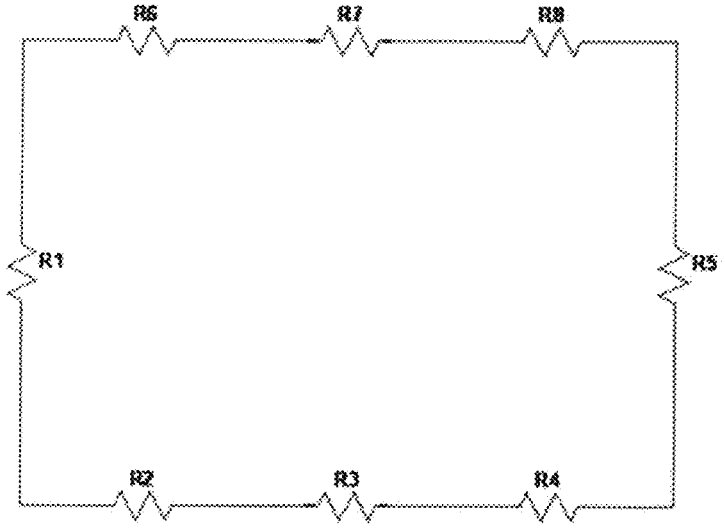
FIG. 3 illustrates the equivalent circuit of the wireless transformer where are represented the magnetic reluctances of the magnetically permeable material and the air gap.

In a wireless power transformer, the primary and secondary side is separated by an air gap. The primary and secondary are made out of magnetically permeable material. The goal is to send power as far as possible, through a bigger gap. In FIG. 3 is illustrated the equivalent circuit of the wireless transformer where are represented the magnetic reluctances of the magnetically permeable material and the air gap.

The desired magnetic flux path is the following: primary structure reluctance R2, R3, R4 then through the air gap reluctance R5 after that it's picked up by the secondary reluctance R8,R7,R6 then through the air gap reluctance R6 and back to the primary.

The reluctance of the air is much higher compared to the one of the magnetically permeable material and is defined by $$\Re_{gap} = \frac{l_{gap}}{\mu_{gap} \cdot \mathrm{Area}_{gap}}$$

where $l_{gap}$ is the gap length, $\mu_{gap}$ is the permeability of the gap and $\mathrm{Area}_{gap}$ is the horizontal section area of the gap. The length of the gap is fixed and given by the nominal distance between the primary and secondary side.

The only way to decrease the reluctance of the air is to increase the horizontal section area. This is achieved by making the lateral plates of the pads bigger. Though, the increase of the lateral plates makes their reluctance bigger, the magnetic flux would not flow through the whole plate and this is undesirable. One way to solve this problem is to split the reluctance of the ears to multiple cells, by adding more winded center rods. The structure created is called a multi-cell structure. This way the magnetic flux generated is spread through the whole area of the ear. As a result, the inductive coupling of the wireless transformer increases, hence the overall efficiency of the system is higher.

4. TWO-CELL PAD

The first version of the invention comprises a magnetically high-permeable material and four windings. The pad is composed by two symmetrical parts that are separated by the air gap, the primary side on the bottom, and the secondary side on top of the primary. The primary contains the lateral plates 9 and 10, the center rods 5, 6 and around them are located windings 1 and 2. The secondary contains the lateral plates 11 and 12, the center rods 7, 8 and around them are located windings 3 and 4. Each side is actually made of two cells with one winding each; as a result the structure presented is a two-cell derivation from the 1 cell structure presented earlier.

Figure 4:
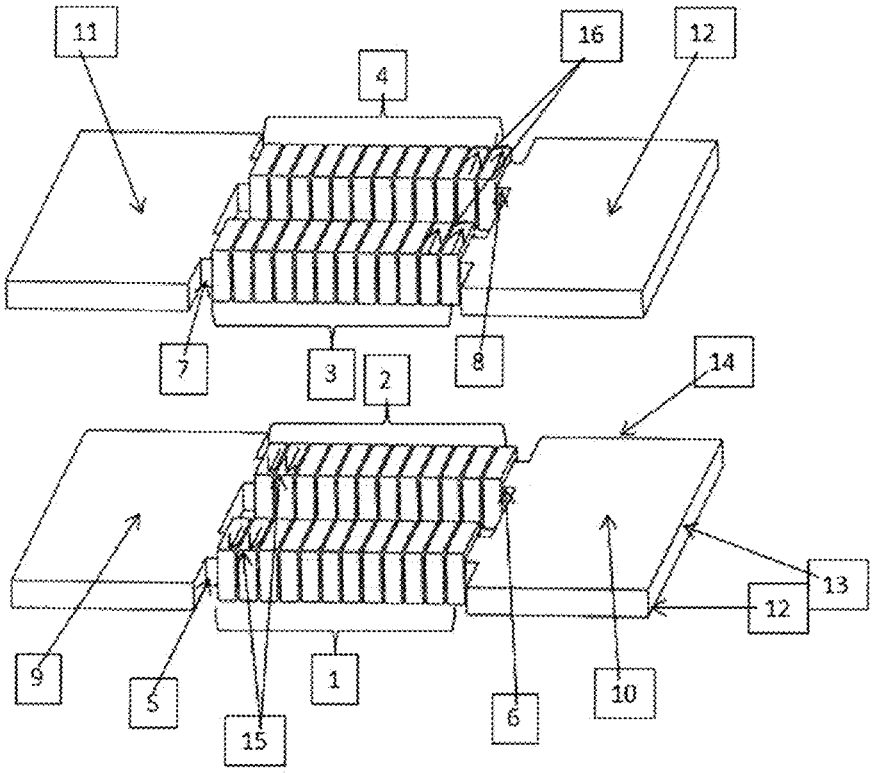
FIG. 4 illustrates a first version of the invention which comprises a magnetically high-permeable material and four windings.
Figure 5:
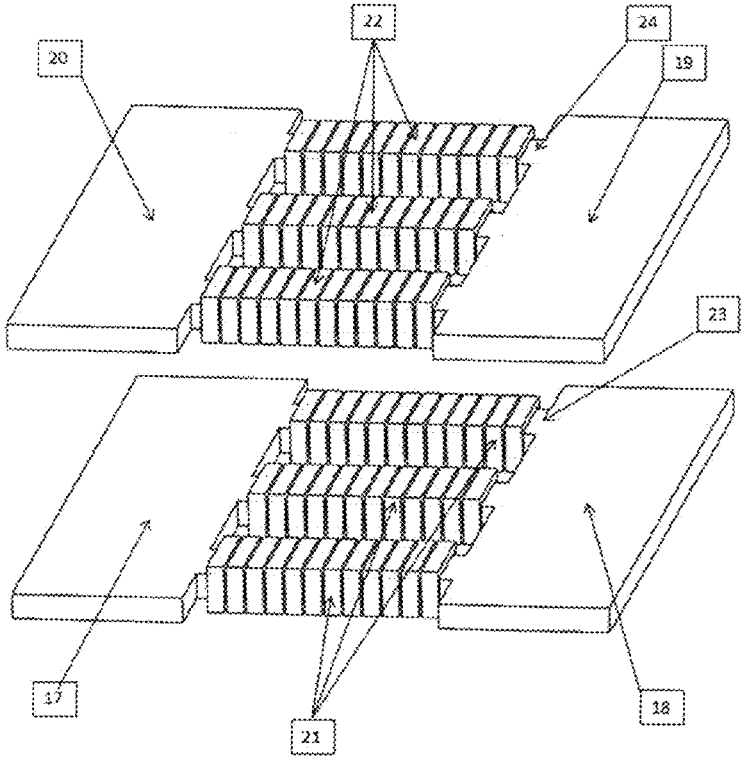
FIG. 5 is a second version of the invention that is derived from the first version and comprises one more cell in addition.
Figure 6:
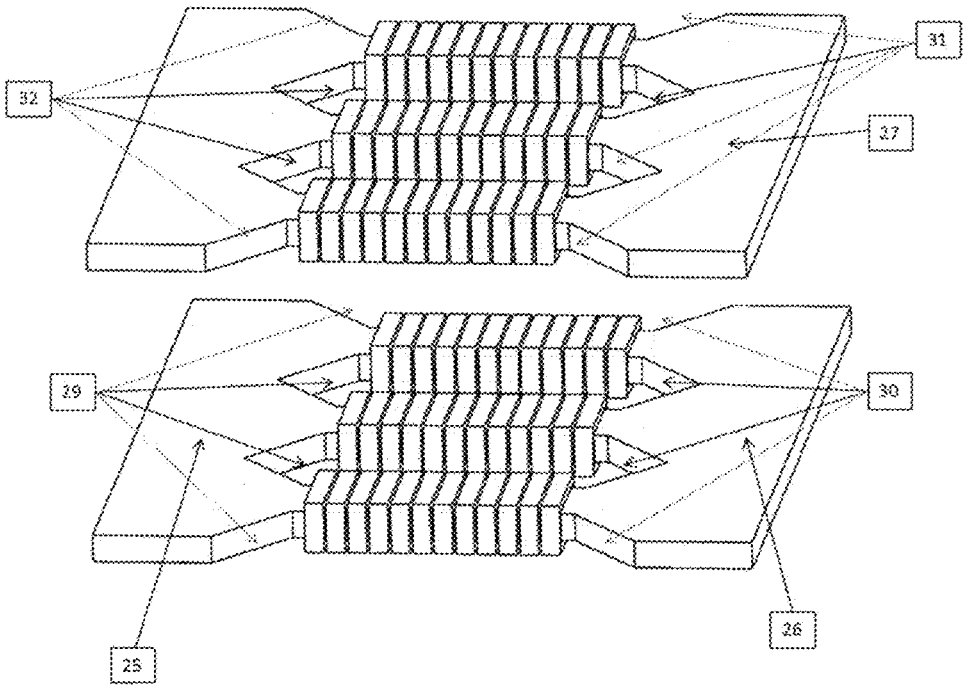
FIG. 6 illustrates a way to increase the magnetic coupling of the wireless transformer by decreasing the undesired leakage flux.

The primary and secondary windings can be connected either in 8 shape, series or parallel as long as the following condition is fulfilled: the currents 15 and 16 flowing through primary or secondary windings have the same direction as depicted in FIG. 4, so that the generated magnetic flux through the rods 5 and 6, 7 and 8 respectively would have the same direction.

One advantage of this structure is the increased magnetic area created by the two lateral plates put together resulting in a better coupled wireless transformer. This leads to more efficient wireless power transfer.

Another advantage of this structure is given by the elongated lateral plates and multiple windings and consist of the lower susceptibility to longitudinal misalignment.

5. THREE-CELL PAD (FIG. 5)

The second version of the invention is derived from the first version and comprises one more cell in addition. This makes it a three cell magnetic structure. The pad is composed by the plates 17, 18, 19, 20, connected by the center rods, the windings 21 and 22 connected in the same manner as described in the first version of the invention. The center rods 23 and 24 accommodate the additional two windings.

This version is further improved compared to to the previous one. It creates even lower air gap reluctance. As a result, the inductive coupling of the wireless transformer is higher and the power is transferred more efficient.

Another advantage of this structure is given by the elongated lateral plates and multiple windings and consist of the lower susceptibility to longitudinal misalignment.

6. THREE CELL PAD WITH INNER CUTS (FIG. 6)

The magnetic flux that is recirculated in the primary side of the transformer and do not energize the secondary side as desired is called leakage flux.

One way to increase the magnetic coupling of the wireless transformer is to decrease the undesired leakage flux. This can be achieved by increasing the path length of the leakage flux.

This version of the invention is composed by the plates 25, 26, 27,28 which have been cut in the areas indicated by 29,30,31,31,32. The cuts are performed in order to create a longer path for the leakage flux lines. This increases the magnetic coupling of the wireless transformer therefore the efficiency of the system is higher.

One advantage of this structure is given by the cuts and lies in the increased magnetic coupling of the wireless transformer therefore the efficiency of the system is higher.

Another advantage of this structure is given by the elongated lateral plates and multiple windings and consist of the lower susceptibility to longitudinal misalignment.

7. MULTI-CELL PAD

Figure 7:
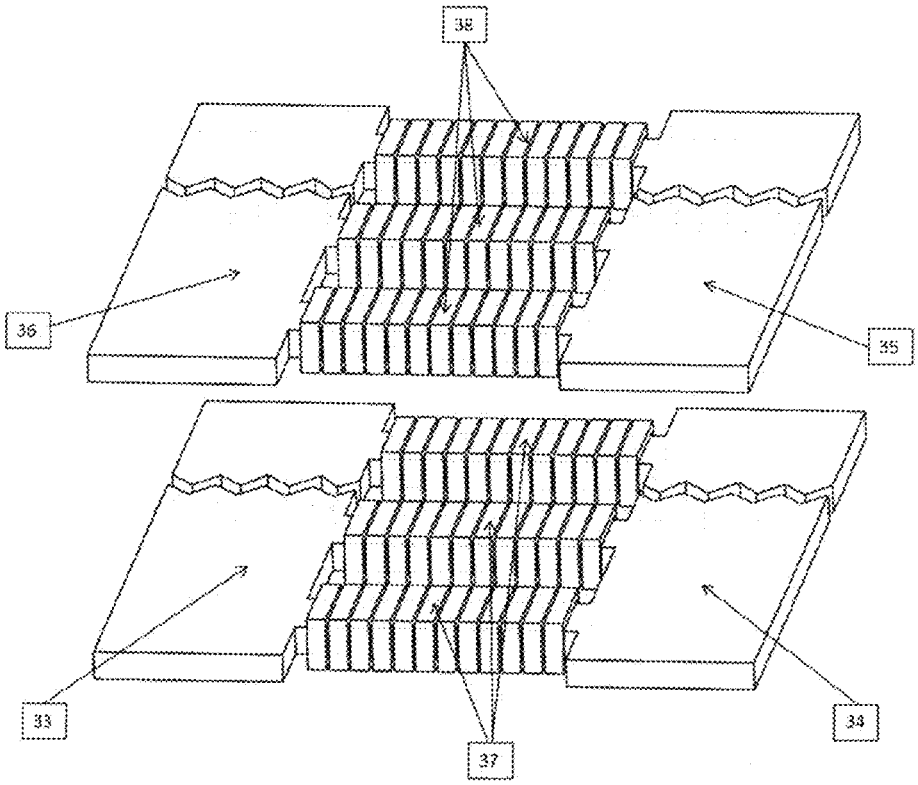
FIG. 7 illustrates magnetic structure that consists of multiple cells and windings connected in the same manner as described in the previous versions, where the number cells is n and there are n windings.

This magnetic structure consists of multiple cells and wdidings connected in the same manner as described in the previous versions. If the number of cells is n there are n windings as indicated in the FIG. 7 by 37 and 38 and the plates 33, 34, 35, 36 are n times longer compared to a single cell structure. This decreases the reluctance of the air gap, as a result the inductive coupling of the wireless transformer increases and the efficiency of the system is higher.

Another advantage of this structure is given by the elongated lateral plates and multiple windings and consist of the lower susceptibility to longitudinal misalignent.

8. MULTI-CELL PAD WITH INNER CUTS

Figure 8:
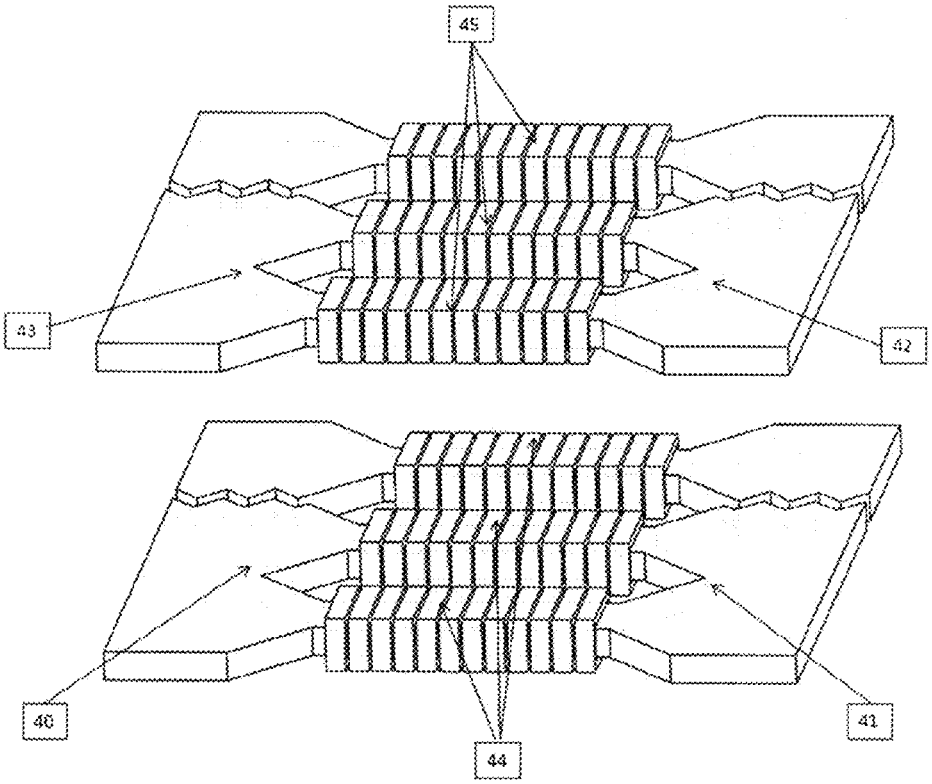
FIG. 8 shows another version of the invention which consists of multiple pads with inner cuts.

In the FIG. 8 is shown another version of the invention which consists of multiple pads with inner cuts. The cuts are located in the inner areas of the plates 40,41,42,43 as indicated. The multiple windings 44 and 45 spread the total flux in the whole magnetic material.

The advantage of this structure is that the total reluctance of the leakage flux path is lower, leading to a better coupled wireless transformer. This increases the efficiency of the wireless power transfer. Besides this we find that the elongated lateral plates give lower susceptibility to longitudinal misalignment.

9. MULTI-CELL PAD WITH LATERAL CUTS

Figure 9:
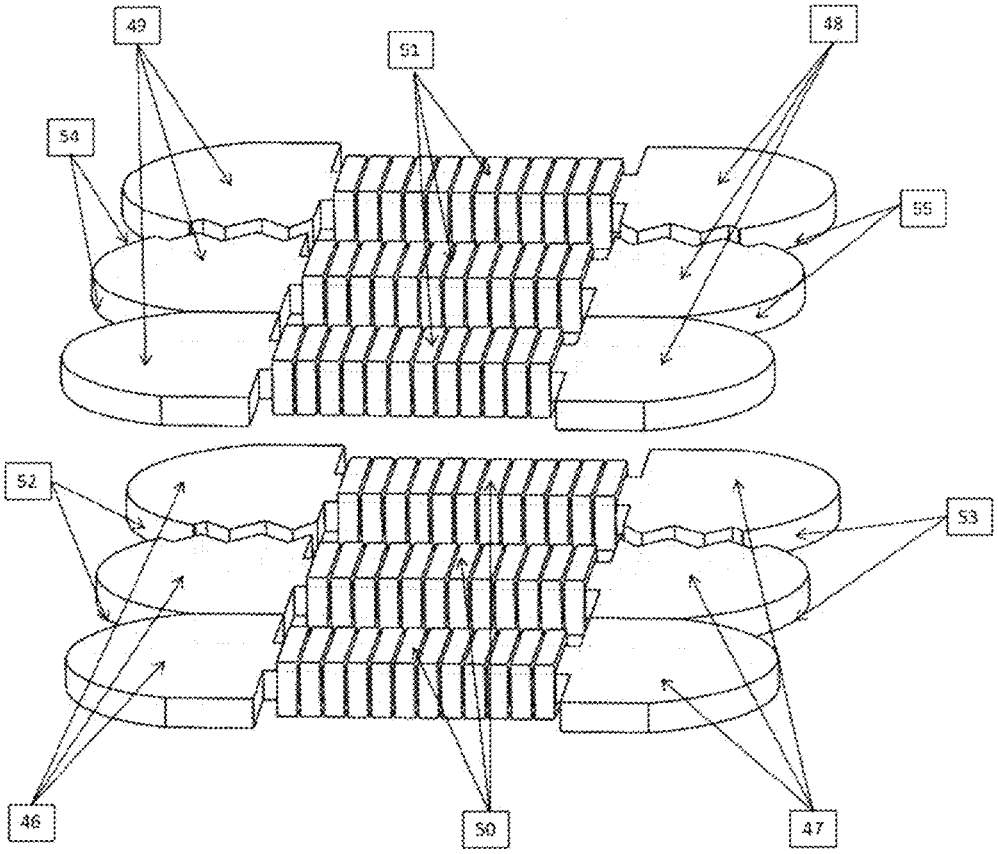
FIG. 9 shows another version of the invention.

Another version of the invention is depicted in FIG. 9. It consist of multiple primary windings 50, secondary windings 51 and lateral plates 46,47,48,49.

The particularity of the structure is represented by the lateral shape of the plates which is round in the areas indicated by 52, 53, 54 and 55 in FIG. 9. This shape increases the area available for the mutual flux lines that are picked-up by the secondary side. As a result, the coupling between the primary and secondary side of the wireless transformer increases and the wireless power is transferred more efficient.

Another advantage of this structure is less susceptible to longitudinal misalignment.

10. MULTI-CELL LINEAR PAD

Figure 10:
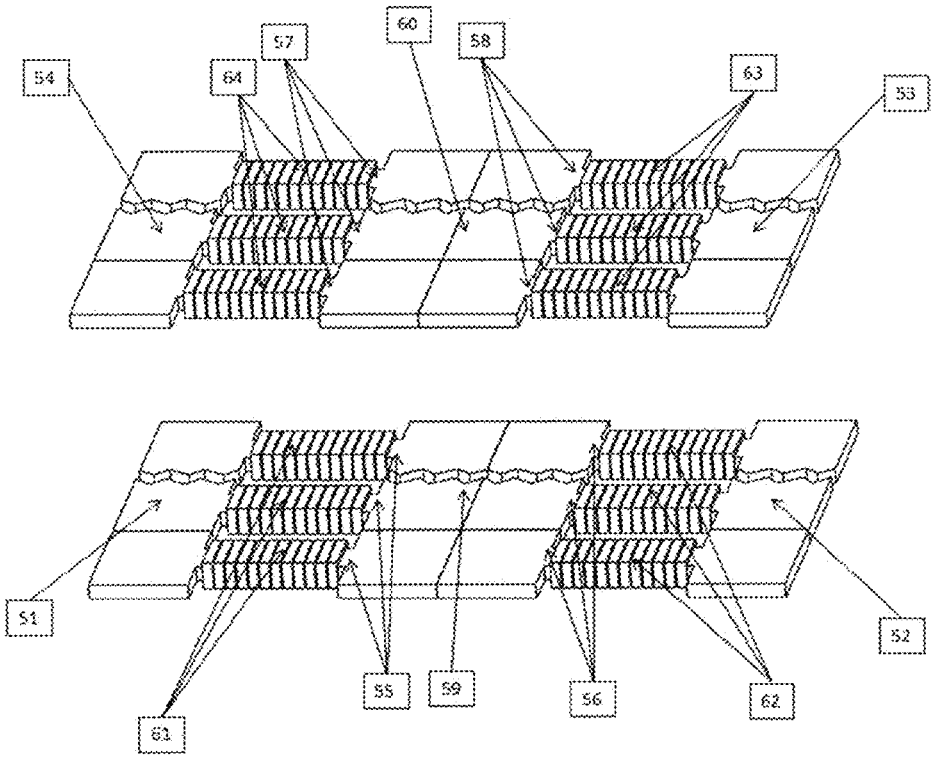
FIG. 10 shows version of the invention that is a multi-cell linear pad.

Another version of the invention is the multi-cell linear pad shown in FIG. 10. The magnetic structure illustrated in FIG. 10 is composed by the primary side on the bottom and the secondary side on top. The primary and secondary are identical in shape and size. Each one of them is made of magnetic material composed by lateral plates 51,52,53,54, central plates 59 and 60, center rods 55,56,57,58 displaced in two rows on which are winded the coils 61,62,63,64.

A magnetic flux is created by the primary windings 61 and 62. The desired path direction of the flux is the following: from extremities of the primary 51,52 through the center rods 55,56, through the central plate 59, through the air gap, to the secondary central plate 60, through the secondary center rods 57,58, through the secondary lateral plates 53,54, through the air gap, and back in the primary plates 51 and 52.

One advantage of this structure configuration is the enlarged center plates 59,60 area, and thus the reluctance of the air gap between the plates is lower. As a result, the coupling of the wireless power transformer is increased.

Another advantage of this structure is given by the elongated lateral plates and multiple windings and consist of the lower susceptibility to longitudinal misalignment.

11. MULTI-CELL C-SHAPED PAD

Figure 11:
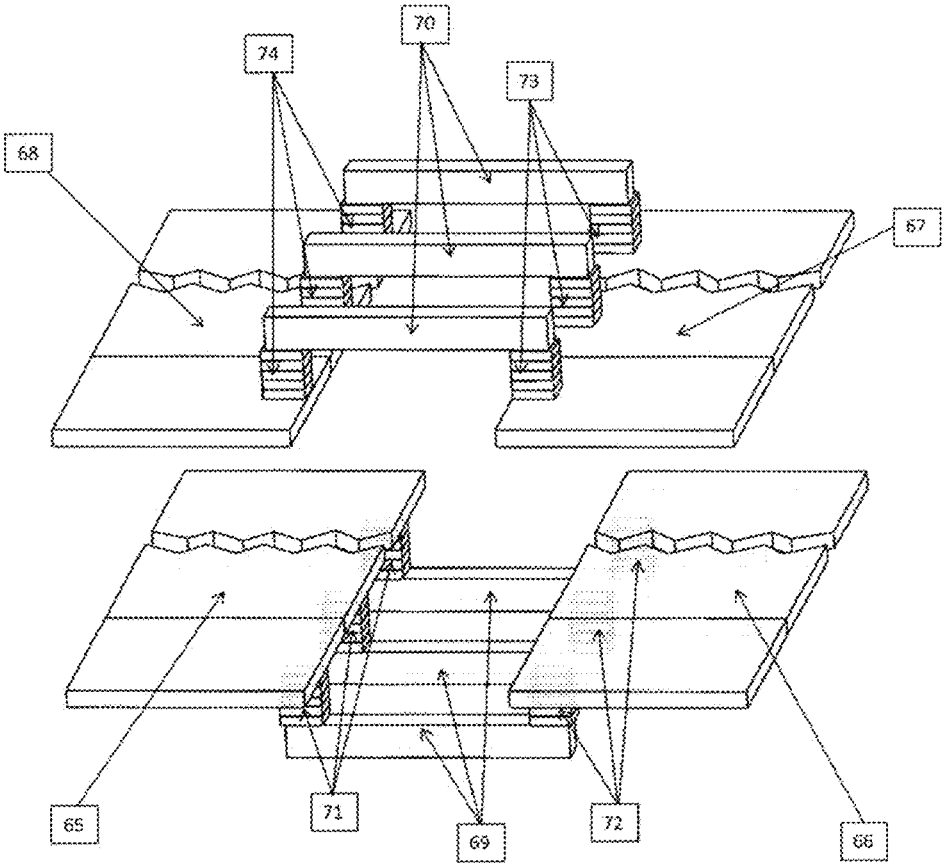
FIG. 11 illustrates shows another version of the invention.

In FIG. 11 is illustrated another version of the invention. The magnetic structure is composed by the primary side on the bottom and the secondary side on top. The primary and secondary are identical in shape and size. Each one of them is made of magnetically permeable material. The magnetic material of the structure is composed by lateral plates 65,66,67,68 and C core rods 69, 70. Each of the primary and secondary cell comprise a pair of windings as indicated by 71,72,73,74.

Preferably the windings are connected in 8-shape in such way that one "pushes" and the other "pulls" the magnetic flux.

The magnetic flux generated by the windings has the following desired path: from lateral plates 65, to rods 69 through plates 66, through the air gap, through plates 67, through rod 70 then through plates 68, through the air gap and back to plates 65.

One of the advantages of this version of the invention is that the windings are magnetically shielded under the lateral plates. The purpose of the shielding is to minimize the AC losses in the winding. As a result, a higher efficiency of the wireless power transfer is achieved.

Another advantage of this structure is given by the elongated lateral plates and multiple windings and consist of the lower susceptibility to longitudinal misalignment.

12. MULTI-CELL C-SHAPED PAD WITH CUTS

Figure 12:
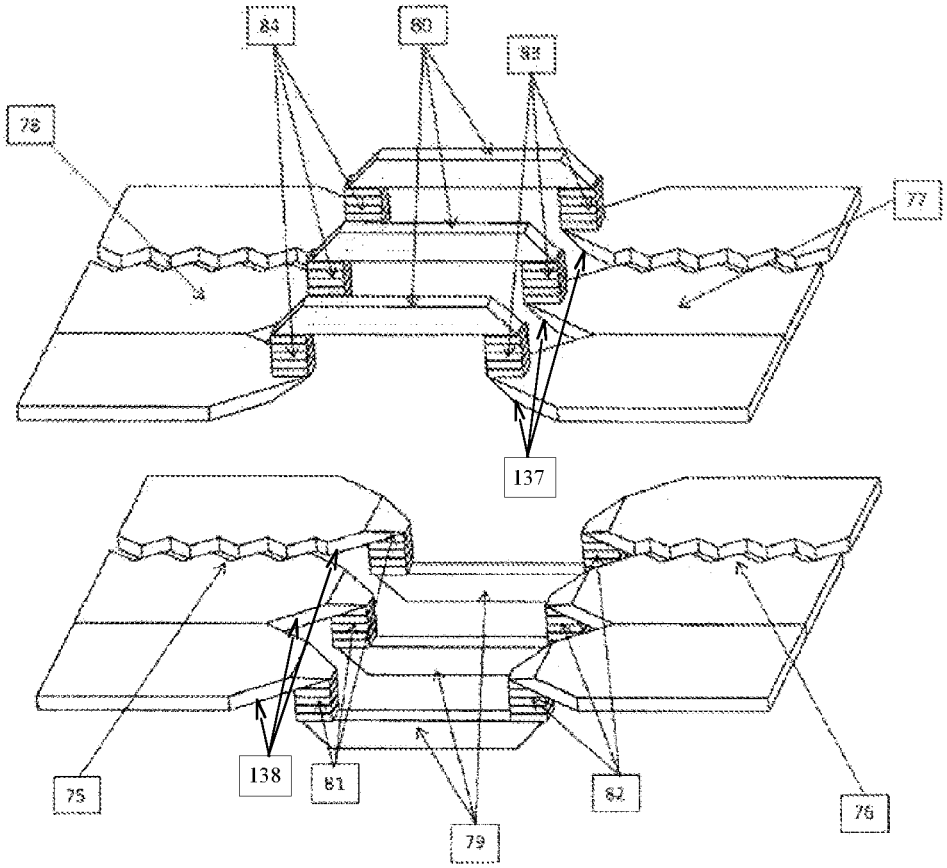
FIG. 12 illustrates another version of the invention.

Another version of the invention is shown by FIG. 12. This structure is similar to the previous one, the difference lie in the cuts 137, 138 performed on the lateral plates and C core rod.

The structure is composed by the primary side on the bottom and secondary side on top. The primary side includes the lateral plates 75,76, C shape rods 79 and the windings 81 and 82. The secondary side includes lateral plates 77,78, C shape rods 80 and the windings 83 and 84.

The desired flux path is the same as in the previous version, as a result the windings is preferred to be connected in the same manner.

One advantage of this structure is the increased reluctance of the path for the leakage flux lines. This increases the inductive coupling between the primary and the secondary therefore a higher wireless power transfer is achieved.

Another advantage of this version is that the AC losses in the windings are lower because they are shielded under the lateral plates.

Another advantage of this structure is given by the elongated lateral plates and multiple windings and consist of the lower susceptibility to longitudinal misalignment.

13. MULTI-CELL C-SHAPED PAD WITH HALF CIRCULAR ROD

Figure 13:
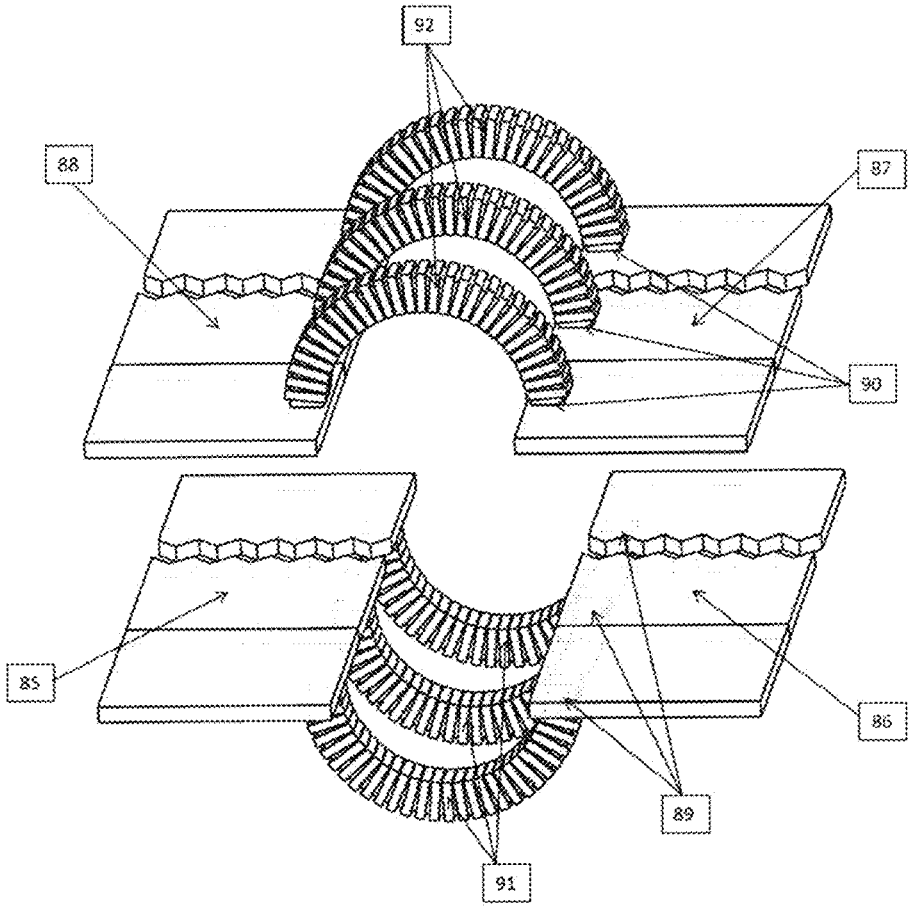
FIG. 13 shows another version of the invention.

FIG. 13 shows another version of the invention. It comprises the primary side on the bottom and secondary side on top each of them made of magnetically permeable material. The structure is composed by the lateral plates 85, 86, 87, 88, center rods 89 and 90 and the windings 91 and 92. The windings can be connected either in 8-shape, series or parallel in such way that the magnetic flux generated have the following preferred direction: from plate 85 through rods 89 to plate 86, through air gap, through plate 87, through rods 90, through plate 88, through the air gap and back to the plate 85.

This structure is similar to the Multi-cell C-shaped Pad, the difference lie in the shape of the rod that links the lateral plates. In this case the rod is rounded creating a shorter path for the magnetic flux which translates in lower reluctance. As a result the coupling of the wireless transformer is higher and this way the power is transferred more efficient.

14. MULTI-CELL E-SHAPED PAD

Figure 14:
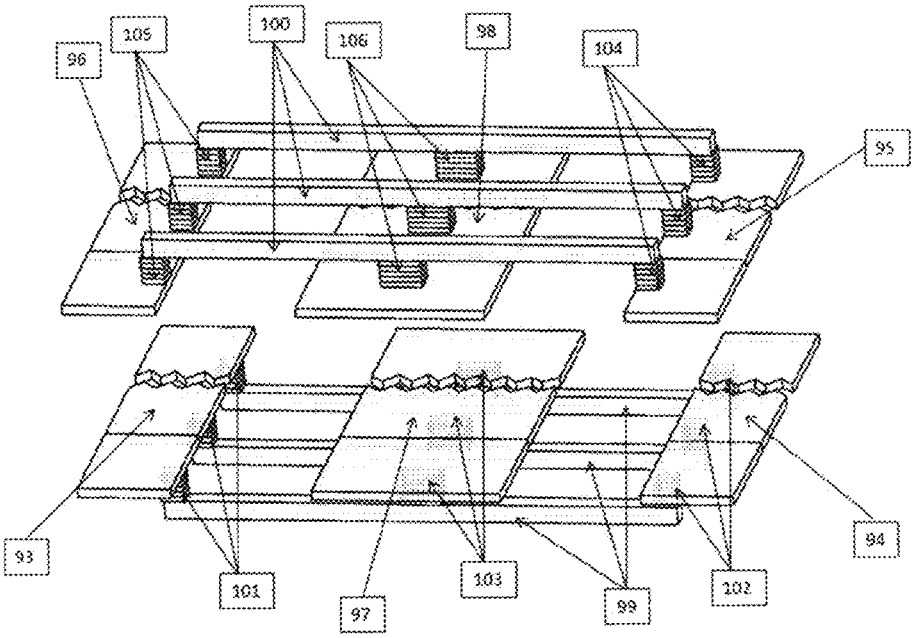
FIG. 14 illustrates another version of the invention.
Figure 15:
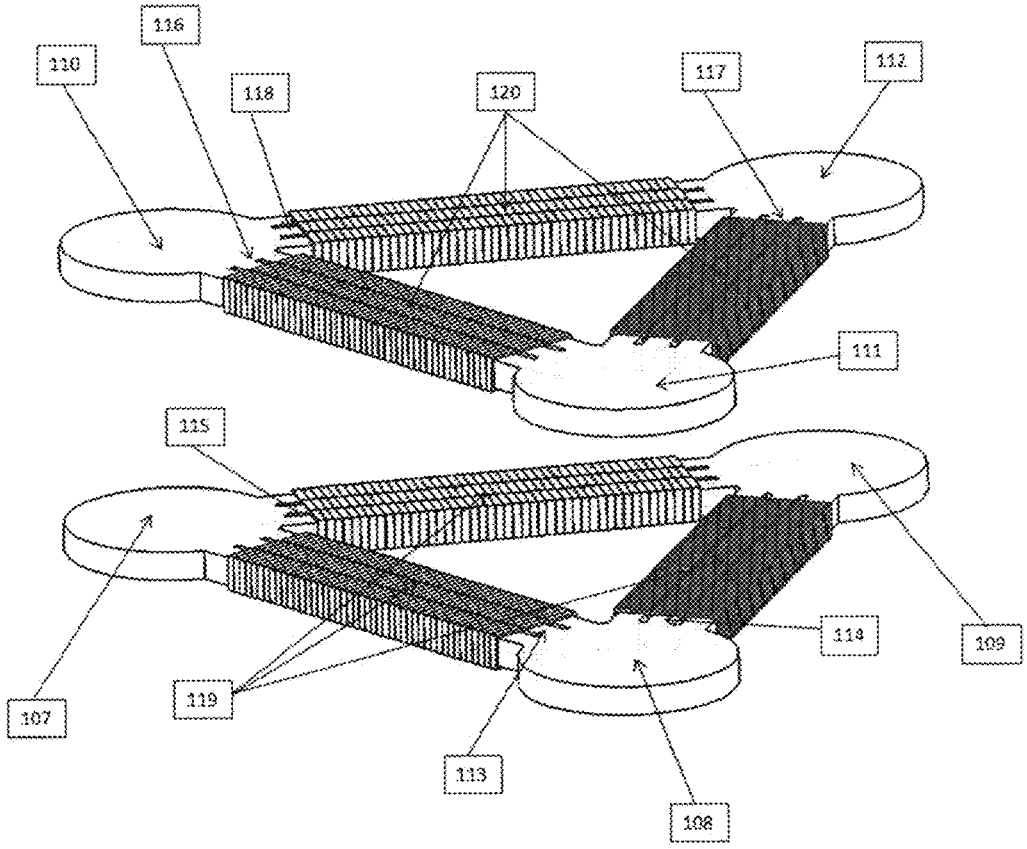
FIG. 15 provides another version of the invention.

In FIG. 14 is illustrated another version of the invention. It comprises the primary side on the bottom and secondary side on top each of them made of magnetically permeable material. The structure is composed by the lateral plates 93, 94, 95, 96, center plates 97, 98, E-shape rods 99, 100 and the windings 101, 102, 103, 104.

Both primary and secondary windings are split on the three posts of the E-shape rod. Preferably, the winding polarities are set in such way that the generated magnetic flux is flowing from the lateral plates 93, 94, through rods 99 to center plate 103 in the primary side, and from center plate 104 through rods 100 to lateral plates 95, 96 in the secondary side.

One advantage that this structure offers is that minimizes the leakage flux between the lateral plates 93, 94 and 95, 96 respectively.

Another advantage of this version of the invention is that the windings are magnetically shielded under the lateral plates. The purpose of the shielding is to minimize the AC losses in the winding. As a result, a higher efficiency of the wireless power transfer is achieved.

15. MULTI-CELL DELTA PAD (FIG. 15)

Here is provided another version of the invention. The magnetic structure comprises of a primary and a secondary assemblies identical in shape and size, but also can be combined with all the magnetic structures described here, and as a result will become non symmetrical primaries and secondaries. The structure can have also a C-shape connection rod between disks.

The structure is made of magnetically permeable material composed by the disks 107, 108, 109, 110, 111, 112, 6 branches of 3 parallel rods 113, 114, 115, 116, 117, 118 on which are located the windings 119, 120.

Preferably, the primary windings are energized with 120 degree separation in phase as follows: At zero degree phase disks 107 and 110 will be the field return path and disks 108, 111, 109, 112 will be the transmission path. The path of the magnetic field at zero phase will be: from disk 107 will split to rods 113 and rod 115. From rod 113 will go to disk 108, through the air gap, through disk 111 through rod 116, through disk 110, through the air gap and back to disk 107. From rod 115 will go to disk 109, through the air gap, through disk 112, through rod 118, through disk 110, through the air gap and back to disk 107. At 120 degree phase disk 108 and 111 will be the field return path and disk 107, 110, 109, 112 will be the field transmission path. At 240 degree phase disk 109 and 112 will be the field return path and disk

107, 110, 108, 111 will be the field transmission path. This tri-phase system creates a rotational magnetic field between all disks.

16. MULTI-CELL Y PAD

Figure 16:
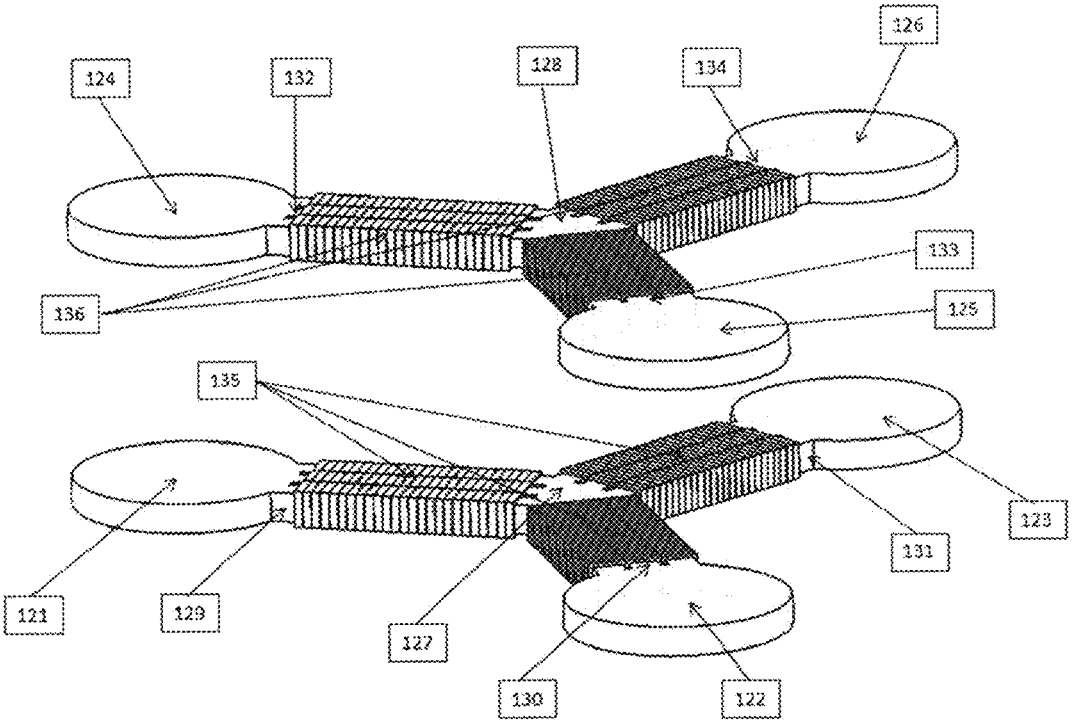
FIG. 16 illustrates another version of the invention.

In FIG. 16 is illustrated another version of the invention. The structure is made of magnetically permeable material and copper wire windings and is composed by the primary side on the bottom and the secondary side on top. Both sides comprise the disks 121, 122, 123, 123, 125, 126, 6 branches of 3 parallel rods 129, 130, 131, 132, 133, 134 the center plates 127, 128, the windings 135, 136.

Preferably, the primary windings are energized with 120 degree separation in phase as follows: At zero degree phase the magnetic field will travel from disk 121 through rods 129, through center plate 127, through rods 130, through disk 122, through the air gap, through disk 125, through rods 133, through center plate 128, through rods 132, through disk 124, through the air gap, and back to the disk 121. At 120 degree phase the magnetic field path is: from disk 122, through rods 130, through center plate 127, through rods 131, through disk 123, through the air gap, through disk 126, through rods 134, through center plate, through rods 133, through disk 125, through air gap and back to disk 122. At 240 degrees the path rotates and is: from disk 123, through rod 131, through center plate 127, through rods 129, through disk 121, through air gap, through disk 124, through the rods 132, through center plate 128, through rods 134, through disk 126, through the air gap and back to disk 123.

REFERENCES

[1] Budhia, M.; Boys, J.; Covic, G.; Huang, C. "Development of a single-sided flux magnetic coupler for electric vehicle IPT charging systems", Industrial Electronics, IEEE Transactions on, Volume: PP, Issue: 99, Publication Year: 2011, Page(s): 1-1.

The invention claimed is:

1. Primary or secondary side pad for a wireless transformer for inductive power transfer through an air gap, including a first plate, a second plate, wherein at least two rods link the first and the second plate where a winding is wound around each rod, the rods being spaced from each other in a lateral direction, wherein a width of the plates in the lateral direction is larger than a distance between outer edges of the farthest rods in said lateral direction in a way that a whole area of in each plate extends beyond the surfaces of the farthest rods on two opposing sides, and wherein a thickness of each plate is smaller than a width of the plate and the length of the plate, the width being the extension of the plate in a lateral direction in which the rods are spaced and the length being the extension of the plate in a direction parallel to rods being linked to the respective plate, the thickness being the extension of the plate in a vertical direction perpendicular to the lateral and to a longitudinal direction which is parallel to rods.

2. The pad according to claim 1, wherein the first and the second plate are linked by two or more rods.

3. The pad according to claim 1, wherein the first and the second plate are linked by three or more rods.

4. The pad according to claim 3, which comprises three plates and three branches with three parallel rods on which are located the windings where the branches are either arranged in a delta shape or a Y shape with a center plate.

5. The pad according to claim 1, wherein at least two windings are connected in series, in parallel or in an eight shape, such that the generated magnetic flux through the rods have a same direction.

6. The pad according to claim 1, wherein the plates have cuts in the inner areas of the plates to decrease a leakage flux.

7. The pad according to claim 1, wherein the plates have a lateral, round shape.

8. The pad according to claim 1, wherein the rods are C-shaped and each rod comprises a pair of windings.

9. The pad according to claim 8 wherein the C-shaped rods comprise cuts to increase a reluctance of the path for the leakage flux lines.

10. The pad according to claim 1 wherein the rods are C-shaped and rounded.

11. The pad according to claim 1, wherein at least two rods allow a generated magnetic flux to spread over the whole area of each plate.

12. Primary or secondary side pad for a wireless transformer for inductive power transfer through an air gap, including a first plate, a second plate, wherein at least two rods link the first and the second plate where a winding is wound around each rod, the rods being spaced from each other in a lateral direction, wherein a width of the plates in the lateral direction is larger than a distance between outer edges of the farthest rods in said lateral direction in a way that a whole area of in each plate extends beyond the surfaces of the farthest rods on two opposing sides, the primary or secondary side pad further comprising a third plate and additional rods, on which are wounded windings, linking the second and the third plate, the three plates being linearly arranged and the rods between the first and the second plate respectively between the second and the third plate being displaced in two rows and the second plate having an enlarged area.

13. The pad according to claim 12 wherein the windings are arranged to generate a flux through the rods to the central plate and through the air gap or vice versa.

14. The pad according to claim 12 wherein the rods form an E-shaped rod, each comprising three posts.

15. The pad according to claim 14 wherein the windings are split on the three posts of the E-shaped rod.

16. A wireless transformer for an inductive power transfer through an air gap, comprising a primary side pad and a secondary side pad, each pad having a first plate and a second plate, wherein at least two rods link the first and the second plate of the respective pad and wherein a winding is wound around each rod, the rods being spaced from each other in a lateral direction, wherein a width of the plates in the lateral direction is larger than a distance between outer edges of the farthest rods in said lateral direction in a way that a whole area of in each plate extends beyond the surfaces of the farthest rods on two opposing sides, the primary or secondary side pad further comprising a third plate and additional rods, on which are wounded windings, linking the second and the third plate, the three plates being linearly arranged and the rods between the first and the second plate respectively between the second and the third plate being displaced in two rows and the second plate having an enlarged area.

17. A wireless transformer according to claim 16, wherein the primary pad and the secondary pad are identical in shape and size.

18. The wireless transformer of claim 16, wherein a current through the winding has a direction that causes generated magnetic fluxes through the at least two rods to have the same direction.

* * * * *